US005390618A

United States Patent [19]

Wolff et al.

[11] Patent Number: 5,390,618

[45] Date of Patent: Feb. 21, 1995

[54] OFFSHORE MOORING SYSTEM

[75] Inventors: Christian V. Wolff, Houston; Thomas S. Burns, Sugarland, both of Tex.

[73] Assignee: Reading & Bates Development Co., Houston, Tex.

[21] Appl. No.: 62,945

[22] Filed: May 17, 1993

[51] Int. Cl.[6] ..... B63B 21/50

[52] U.S. Cl. ..... 114/230; 114/293

[58] Field of Search ..... 114/230, 293, 264, 265; 166/352; 405/224, 224.3, 224.4

[56] References Cited

U.S. PATENT DOCUMENTS 3,151,594 11/1964 Collipp ..... 114/230

4,170,186 10/1979 Shaw ..... 114/293

FOREIGN PATENT DOCUMENTS 2176568 12/1986 United Kingdom ..... 114/293

OTHER PUBLICATIONS pp. 64 & 65 of Int. Maritime Dictionary Jan. 1948.

*Primary Examiner*—Ed Swinehart

[57] ABSTRACT

A mooring system for mooring a vessel off-shore, which comprises a block located in the water at a depth below expected wave action and at a distance from the vessel; a mooring line extending from line pulling equipment on the vessel, through the block and back, for releasable attachment to the vessel; mooring tackle attached to the block and extending away from the vessel to an anchor. The mooring line and mooring tackle form a catenary, between the vessel and the anchor, which has a curve adapted to maintain the anchor securely attached to the bottom and to maintain the block below the depth of expected wave action. Preferably, the mooring line passes from the pulling equipment through a fairlead located near the vessel's waterline, and then to the block.

13 Claims, 2 Drawing Sheets

OFFSHORE MOORING SYSTEM

BACKGROUND OF THE INVENTION

1. Field of the Invention

The present invention relates to systems and methods for mooring vessels offshore. Particularly, the present invention relates to systems and methods for mooring vessels which will be expected to remain on station for extended periods of time, or perhaps permanently, under weather conditions which may include heavy seas, high winds and strong currents. More particularly, the present invention relates to systems and methods for mooring floating ships, barges and semi submersible vessels employed as drilling vessels, tenders, oil production vessels and oil storage vessels and barges.

2. Background of the Invention

A mooring system for vessels intended to be moored offshore is a large, expensive set of equipment comprising several thousand feet of mooring line comprising chains and wire lines, a windlass or winch with redundant braking systems for deploying, tensioning and retrieving the mooring line, fairleads for directing the mooring lines, line swivels to prevent kinks in the mooring chains, anchors (or alternatively a mooring piling) for providing holding power to keep the vessel moored on station, as well as a variety of specialized equipment to satisfy various mooring conditions. For each mooring point of a vessel, separate mooring tackle is required. The mooring line of each mooring tackle will be attached to an anchor, or, in some circumstances, to a piling driven into the bottom. Each ship will have a minimum of two mooring points, and some vessels such as drill ships, semi submersibles, tenders, oil production vessels and oil storage vessels, which are expected to remain on station for extended periods of time, may have eight to sixteen mooring points.

Mooring systems are designed to industry standards to ensure that the mooring systems provide the holding power required to withstand expected weather and sea conditions. Typically, mobile offshore vessels, such as drill ships and semi submersibles engaged in drilling operations, are designed to withstand maximum weather conditions expected during a 5–10 year period within their areas of expected operation. On the other hand, floating production vessels of similar size and type are designed for maximum weather conditions expected during a 50–100 year period in their area of intended operation. Consequently, floating production vessels are designed with two to three times the mooring strength of drilling vessels.

Increased attention to personnel safety and environmental protection is creating a trend toward requiring increased mooring strengths for mooring systems, particularly for vessels in offshore oil and gas drilling service. Additionally, with current economic conditions, operators often wish to employ drilling vessels, in areas having more severe weather conditions than conditions for which the vessel mooring systems were initially designed. Also, operators are finding it economically attractive to convert existing drilling vessels into production vessels which require much stronger mooring systems. In each of these circumstances means must be found for increasing the strength of the existing vessel mooring systems, or the existing mooring systems must be replaced with stronger mooring systems. Replacement of existing vessel mooring systems is doubly expensive. Not only must the new, stronger mooring systems be procured and installed, the existing mooring systems must be removed and scrapped.

Each mooring system for large vessels may cost in the millions of dollars. For vessels having eight or more mooring systems, mooring system may cost in the tens of millions of dollars.

3. Description of Pertinent Art

In the past, tender barges, designed for mooring along side fixed drilling and production platforms in the Gulf of Mexico, employed a plurality of mooring systems in order to hold the tenders on station adjacent the platforms with little lateral movement. The tenders employed up to eight mooring points for attachment to anchors, or very often, to permanently set anchor piling driven into the bottom. Each anchor or piling had a mooring line running upward and attached to a raft buoy at the water surface. Each raft buoy was large enough to hold its mooring line on the surface at all times, including times when a tender mooring line was attached and tensioned to moor the tender in place. A large sheave was mounted on each raft buoy. To moor a tender, a soft line was run out from the tender, through the sheave and back to the tender. This soft line was attached to a vessel mooring line which was then pulled out through the sheave and back to the tender where the end of the vessel mooring line was tied-off. This step was repeated for each sheave on each raft buoy. The vessel mooring lines were then taken-up and tensioned to position the tender alongside the platform. This mooring system was designed for shallow water and mild weather conditions. In heavy weather, the tender could slip its moorings for a tow to port by releasing the end of each vessel mooring line and pulling the vessel mooring lines back to the tender through the raft buoy sheaves.

This method for mooring tenders has several disadvantages which make it not useful for mooring larger vessels in deep waters or in heavy seas. The raft buoys, located at the water surface, were subject to wave action. In heavy seas, the raft buoys tended to lift the anchors, if anchors were used, or break the mooring lines if the anchors held to the sea bed, or if mooring piling were used instead of anchors. Additionally, the mooring lines from the tender to the raft buoys were at water surface level, subject to wave action, and were an obstruction to supply and service boats

SUMMARY OF THE INVENTION

An object of the present invention is to provide improved mooring systems for off shore mooring of vessels.

Another object of the present invention is to provide economical mooring systems requiring windlasses or winches of reduced pulling power compared to conventional mooring systems.

Another object of the present invention is to provide modifications to existing mooring systems for increasing mooring strength and effective pulling power without replacing existing winch, windlass and brake equipment.

According to the present invention, the improvement to a vessel mooring system includes a mooring line from the vessel mooring system reeved through a sheave mounted in a sheave block having a clevis for attachment to an anchor line. The free end of the mooring line, after being reeved through the sheave, is returned and secured to the vessel. The sheave block, run out a distance from the vessel, is attached to an anchor line. When positioned for mooring, the sheave block is deployed in the water at a depth sufficient to keep the sheave block both clear of the sea bed (or any obstructions) and clear of wave action during the roughest seas expected at the mooring location. This improvement to mooring systems allows the pulling power of the windlass and winch equipment upon the anchor lines to be effectively doubled without necessity of replacing onboard components of the mooring systems. The improvement of the present invention may be used with new mooring systems, thus allowing winches and windlasses with less pulling power to be used, or maybe used to refurbish existing mooring systems to increase the effective pulling power of existing winches and windlasses. The improvement of the present invention finds particular advantage in use for conversion of vessels and barges from drilling service to crude oil production and storage service, whereby the mooring strength of the vessel mooring systems can be increased for minimum cost.

These and other advantages of the present invention will become apparent in the detailed description of the invention which follows.

DESCRIPTION OF CONVENTIONAL MOORING SYSTEM

The present invention will be described below in this specification with reference to a semi submersible drilling vessel, although it will be realized that the invention may be employed on vessels of other types, such as ships and barges. Therefore, a description of a conventional mooring system used on a typical semi submersible drilling vessel may help in understanding the improvement of the present invention.

Semi submersible drilling vessels are commonly equipped with eight to sixteen self contained chain, wire line or combination chain-wire line, sets of mooring tackle mounted symmetrically about the vessel on columns which support the vessel platform upon pontoons. The equipment and tackle for each mooring point of a particular vessel are generally substantially identical, therefore the description below with reference to FIG. 1 will be limited to the mooring equipment for one mooring point for such vessel.

Figure 1:
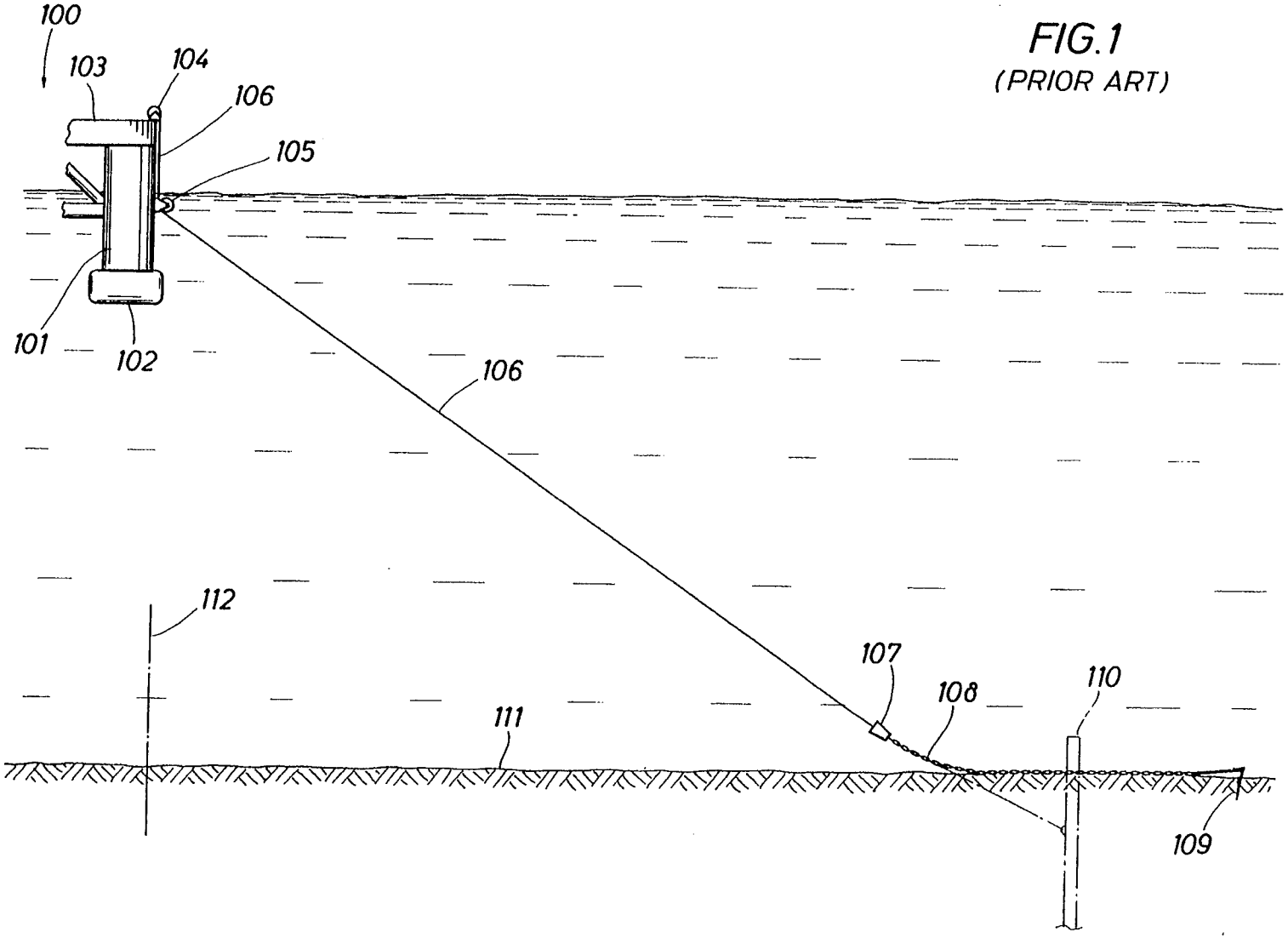
FIG. 1 (PRIOR ART)
FIG. 1 of the drawings is a schematic representation of a typical prior art vessel mooring system.

In FIG. 1, only a portion of vessel 100 is shown, with one column 101, one pontoon 102 and a portion of weather deck 103 shown. Generally such semi submersible drilling vessels have four to eight columns, mounted on two pontoons, with two or three mooring points for each column.

In FIG. 1, winch 104 is mounted on weather deck 103 of vessel 100 for deploying and retrieving vessel mooring line 106. Winch 104 is representative of mooring line pulling equipment employed in vessel mooring systems. Such pulling equipment may comprise a single winch, as shown by winch 104, or may comprise a chain windlass or combinations of winches, linear winches traction winches, storage winches, windlasses, hydraulic chain pullers and other pulling equipment. For describing the improvement of the present invention, winch 104 is sufficiently representative of such pulling equipment. Winch 104 is equipped with a brake system, not shown, for holding mooring line 106 under tension during periods when vessel 100 is moored. Winch 104 has a pulling power not greater than the break strength of mooring line 106, and preferably about one-half the break strength of mooring line 106 for safety considerations.

In FIG. 1, mooring line 106 passes from winch 104, down the outside of column 101, through fair lead 105 to swivel 107. In this instance, where the vessel is semi submersible, fairlead 105 is attached to column 101 near the water line for providing stable mooring for vessel 100. For other vessels, such as ships, for which the height above the water line is not as great, the fair lead will be mounted higher up on the hull, or on the vessel deck. Fair lead 105 may comprise a sheave which rotates as mooring line 106 is pulled through, or a closed chock. which is a curved metal apparatus around which mooring line 106 is pulled, or a fairlead shoe having low friction surfaces or having bearings over which the vessel mooring line may run. Frequently, the fairlead is swivel mounted on the column for allowing the fairlead to be open in the direction in which the vessel mooring line is running out from the vessel. The purpose of fair lead 105 is to provide a radius of curvature which will prevent mooring line 106 from crimping as it changes direction in passing from vessel 100 into mooring position. In FIG. 1, mooring line 106 consists of high strength wire line (stranded cable) and/or chain. Break strength of the chain and wire line components of mooring line 106 are about equal. When used in combination, chain and wire line are linked by conventional means in various linear combinations to make up mooring line 106 to suit mooring conditions encountered. Either wire line only, or chain only, or combinations of chain and wire line may be employed in mooring line 106.

In FIGS. 1, mooring line 106 leads off fairlead 20 and terminates at swivel 107. Swivel 107 is attached to a length of heavy anchor chain 108 which, in turn, is attached to anchor 109. Alternatively, anchor chain 108 may be attached to anchor piling 110, (shown in ghost outline) rather than anchor 109. Anchor 109, (or anchor piling 110), is set in the sea bed 111, providing holding power for moored vessel 100.

Swivel 107 allows any torsional twisting force in the mooring line to be relieved without being transmitted to the anchor chain 108. Also, swivel 107 allows any twist imposed upon anchor chain 108 by turning anchor 109 to be relieved. In general, chains will not absorb much twisting force, and the links tend to kink rather than rotate when a torsional twisting force is imposed. Such kinking puts undue stress on the chain links, and applying linear tension to a kinked chain may result in early failure of the stressed links at a tension well below the break strength of the chain. Wire lines used in mooring vessels are generally stranded wire or spiral wound lines. Stranded wire lines comprise a number of strands composed of a number of small wires twisted together. The strands, in turn, are twisted together to form the wire line. When such wire lines, composed of strands of twisted wire twisted to form the line, are placed under linear tension, the twisted wires and twisted strands tend to untwist, creating a rotational torque in the line. Rotational torque in the line is undesirable, as the wire line transmits this rotational torque, as a twisting force, to other components of the mooring tackle, such as the mooring and anchor chains. The amount of rotational torque generated in a tensioned wire line may be substantially reduced by various methods employed in manufacturing the line. For example, in a "regular lay" wire line, the wires in the strands are twisted in one direction, such as clockwise, and the strands are twisted together in the other direction, such as counter clockwise. In "torque balanced wire line, the wires in one strand are twisted in one direction, such as clockwise, and the wires in the next strand are twisted in the opposite direction, such as counter clockwise. Spiral wound line comprises a plurality of layers of wires with the wires of one layer being laid up with a lay angle opposite to the lay angles of wires in adjacent layers. As a result of reversing the twist on components of a wire line, under linear tension the rotational torque created by wire line components with twist in one direction will counter balance the rotational torque created by wire line components with twist in the other direction, such that the resulting rotational torque in the wire line as a whole is substantially reduced.

For drilling and production vessels such as vessel 100, a plurality of mooring lines and anchors are deployed radially away from the vessels to resist environmental forces due to wind, waves and sea currents from any direction. This arrangement of mooring lines is known as a "spread mooring system". The primary purpose of the spread mooring system is to hold a moored vessel within a limited circle about the center of its station. For example, a semi submersible drilling vessel is held in a limited circle about the well center on the sea floor to allow drilling operations to proceed as continuously as possible. By limiting permitted excursions from this center, and by managing differential mooring tensions between the mooring lines, this spread mooring system provides the restoring force needed to maintain the vessel on station under the influence of upsetting weather conditions and sea currents. Generally, the mooring lines and anchors are symmetrically spread around the vessel.. Under certain conditions, however, other mooring patterns may be used. For example, a ship may employ only two mooring lines with anchors deployed to hold the ship's bow into the prevailing wind or current. Mooring line diameters, lengths and distance to anchor should be based upon the most severe storm and sea conditions that may be encountered at the mooring station.

Upon setting anchor 109 at a desired location on the sea bed and testing its holding strength, (along with setting and testing anchors for the other mooring systems on the vessel), mooring line 106 is tensioned to provide the force required to keep vessel 100 within a desired circle about the center of its station. Factors considered in determining the correct tension on mooring line 106 include: the radius of excursion which vessel 100 will be allowed about the center of its station; the weight and length of mooring line 106; the distance to anchor 109; the combination of chain and wire line in mooring line 106; clump weights and/or spring buoys attached along mooring line 106; water depth and slope of the sea bed 111 near the location of anchor 109; etc. It is desirable that the tension applied to mooring line 106 not exceed 15% to 25% of the break strength of mooring line 106 under normal weather conditions, and not exceed 50% to 60% of break strength under storm conditions.

In FIG. 1, mooring line 106 hangs downward in a cantenary curve from fairlead 105 to the point where anchor chain 109 contacts the sea bed 112. The degree of curvature of this cantenary curve is dependent upon the weight and length of mooring line 106, and the tension exerted. The distance to anchor is the horizontal distance from anchor 109 to a point 112 vertically below fair lead 105. Mooring line 106 is always longer than the distance to anchor 109, (or to anchor piling 110).

The holding power of anchor 109 is determined by the horizontal pull exerted by mooring line 106 upon anchor 109. Any upward vertical pull on anchor 109 tends to dislodge anchor 109 from the sea bed, and thus lessens its holding power. Therefore, it is desirable that anchor chain 108 be horizontal at its point of connection with anchor 109 for reducing any upward component of force exerted on anchor 109. For a given tension, the curvature in mooring line 106 increases as its length increases. Therefore, preferably the length of mooring line 106 is selected to maintain anchor chain 109 on the sea bed under maximum tensions expected in mooring vessel 100. For drilling vessels and other vessels with a plurality of anchors, the anchors are generally deployed to their positions on the sea bed and attached to their mooring lines by small vessels equipped for the purpose. The anchors are deployed to their positions and set in the sea bed until the anchors dig into the sea bed and provide the desired holding power for mooring the vessel. For ships, and other vessels with only one or two anchors, the ships generally drop and set their own anchors for offshore mooring, without assistance

DETAILED DESCRIPTION OF A PREFERRED EMBODYMENT OF THE PRESENT INVENTION

The improvement of the present invention may be applied to existing mooring systems of vessels for increasing the mooring strength of the mooring systems while retaining the major portion of the existing on board mooring equipment such as windlasses, winches, brakes, guide sheaves, fairleads, etc. Also, the improvement of the present invention may be applied to new mooring systems placed on vessels, thereby allowing use of on board mooring equipment having less pulling power than would otherwise be required with other known mooring systems. In either case, cost savings due to use of the improvements of the present invention will be substantial. In some cases, for large vessels with multiple mooring points, cost savings will be in the tens of millions of dollars.

Figures 2, 3:
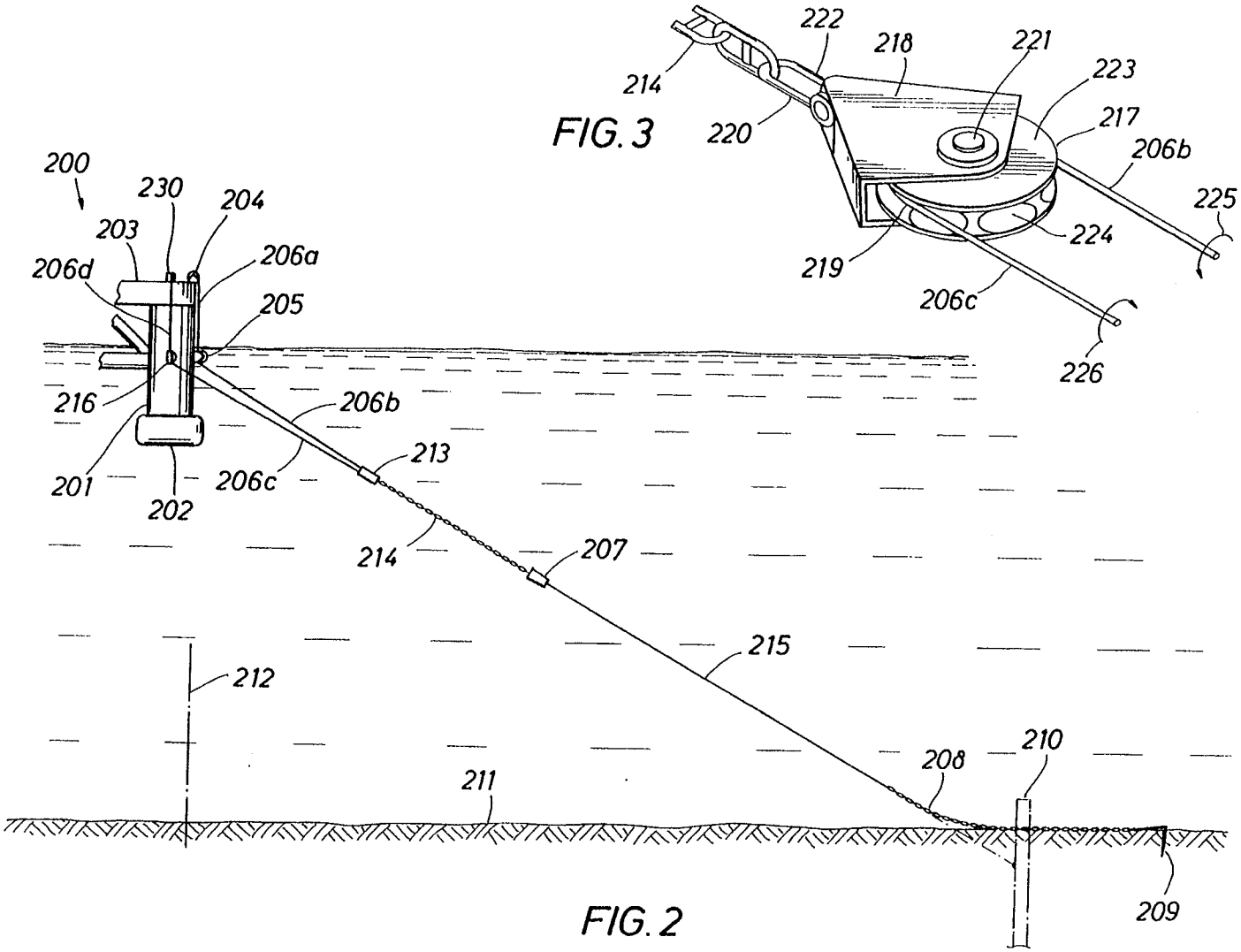
FIG. 2 of the drawings is a schematic representation of a vessel mooring system embodying the improvements of the present invention.
FIG. 3 of the drawings is a schematic representation of a typical sheave block which may be employed in the improvements of the present invention.

FIG. 2 of the drawings shows a preferred embodyment of the improvement of the present invention applied to the mooring system on the semi submersible drilling vessel described above. In order to clearly show the improvement of the present invention, only one typical mooring systems is shown in FIG. 2. The above descriptions of equipment and tackle in the conventional mooring system apply as well to such equipment employed in the improved mooring system of the present invention, shown in FIG. 2 and described below It will be understood that the mooring system shown in FIG. 2 is a simple one with few components, selected to allow a focus on the improvements of the present invention without an undue amount of description being devoted to components which may be present in mooring systems, but which are not necessary for understanding of the improvements of the present invention. Concomitantly, it will be understood that a variety of additional mooring system components, both vessel mounted equipment and mooring tackle, may be employed in mooring systems embodying the improvement of the present invention.

In FIG. 2, Only column 201, pontoon 202, and a portion of weather deck 203 of vessel 200 are shown. Generally, a semi submersible vessel, such as vessel 200, will have two pontoons and four to eight columns. Winch 204 is mounted on weather deck 203 and provides pulling power and braking for deploying, tensioning and holding vessel mooring line 206. Vessel mooring line is connected to winch 204, and has a free end. From winch 204, a first portion 206*a* of vessel mooring line 206 passes down the outside of column 201 through first fairlead 205. First fairlead 205 may be any conventional fair lead, such as fairlead 105 shown in FIG. 1 and described above. First fairlead 205 is attached to column 201 at about the water line for providing stability to moored vessel 200. Vessel mooring line 206 changes direction in first fairlead 205, and a second portion 206*b* of vessel mooring line 206 runs out to block 213. Vessel mooring line changes direction in block 213, and a third portion 206*c* of vessel mooring line 206 runs from block 213 to second fairlead 216 on vessel 200. A drawing of block 213, showing its preferred components is shown in FIG. 3, and is described below.

In FIG. 2, vessel mooring line 206 changes direction in second fairlead 216 and a fourth portion of vessel mooring line 206*d* runs upward from second fairlead 216 to line attachment means 230 on vessel deck 203. The free end of vessel mooring line 206 is ,releasably attached to line attachment means 230. Second fairlead 216 is attached to column 201, and is laterally spaced from first fairlead 205 to prevent entanglement or chaffing between portion 206*b* and portion 206*c* of vessel mooring line 206. Second fairlead 216 may be mounted on a vessel structural member other than column 201, and may be mounted at the same elevation or vertically higher or lower than first fairlead 205, so long as the necessary lateral separation is maintained between first fairlead 205 and second fairlead 216.

In FIG. 2, line attachment means 230 may be any convenient means for releasably attaching the free end of vessel mooring line 206 to vessel 200, such as a bollard, a pad eye, a "dead man", etc. Line attachment means 230 is positioned in a location conveniently reached by ships personnel for releasing vessel mooring line 206, such that vessel 200 may slip its mooring if necessary. Preferably, line attachment means is located on weather deck 203.

In the preferred embodiment of the improvement of the present invention shown in FIG. 2, second fairlead 216 provides means for changing the direction of vessel mooring line 206 from the horizontal direction of vessel mooring line portion 206*c* to the upward direction of vessel mooring line portion 206*d*, and may comprise a sheave, a closed chock, or a fairlead shoe, such as fairlead 105 shown if FIG. 1 and described above, or may comprise other fairlead means. Preferably, second fairlead 216 comprises a sheave.

In an alternative improvement of the present invention, second fairlead 216 may be replaced with attachment means to which the free end of vessel mooring line 206 can be attached, such as a pad eye, a dead man, or other suitable means. Such alternative means, if used, are positioned at the same location occupied by second fairlead 216, and vessel mooring line 206 terminates at the alternative attachment means. Consequently, the fourth portion 206*d* of vessel mooring line 206 and line attachment means 230 are not required.

In FIG. 2, Block 213 is attached to the upper end of block tail chain 215. Alternatively, wire line may be used in place of chain as a tail line 215 from block 213 The lower end of block tail chain 215 is attached to the upper end of tail swivel 207. The lower end of tail swivel 207 is attached to the upper end of mooring wire line 215. The lower end of mooring wire line 215 is attached to the upper end of anchor chain 208. The lower end of anchor chain 208 is attached to anchor 209, or alternatively to anchor piling 210 (shown in ghost outline). Anchor 209, or alternatively anchor piling 210, is firmly set in the sea bed 211 for providing holding power for moored vessel 200.

FIG. 3 is a detail showing block 213 in isometric view. Block 213, provides a connecting link between vessel mooring line 214, and mooring line 215, and subsequently anchor 209. As shown, block 213 comprises a sheave 217, a cover 218. a pin 221 connected to cover 218 and serving as an axle for sheave 217, and a "pad eye" 222 in the end of cover 218 opposite from sheave 217. Vessel mooring line 206 is shown threaded around sheave 217, and block tail chain 214 is shown attached to pad eye 222 by shackle 220.

In FIG. 3, sheave 217 is a pulley wheel with a concave outer periphery 219 and sides 223. Vessel mooring line 206 rides in the concavity of sheave periphery 219, and sheave 217 rotates as vessel mooring line 206 is pulled through, thus reducing friction between the two. Sheave 217 has a diameter sufficiently large that vessel mooring line 206 can bend around sheave 217 without undue stress or crimping. For large vessels, such as semi submersible vessels and ships, mooring lines may be in the range of three to four inches diameter, and the sheaves necessary will be in the range of five to ten feet in diameter. Mooring lines may be larger and smaller than these dimensions and their sheaves will be sized accordingly. Alternatively, sheave 217 in block 213 may be replaced with any convenient fairlead means, such as a closed chock or a fairlead shoe. Such alternative fairlead means, if used, have the same function as sheave 217.

In FIG. 3, cover 218 is close fitted to the sides 223 of sheave 217 to prevent vessel mooring line 206 from jumping out of concave periphery 219 of sheave 217. Pad eye 222 of cover 218 is attached to tail chain 214 by shackle 220. Other means, such as replaceable chain links or swivels, may also be used in place of shackle 220 an pad eye 222 for connecting block 213 to tail chain 214.

In FIG. 3, vessel mooring line 206, which passes around swivel 217, is shown as a wire line. When vessel mooring line 206 is a wire line and is tensioned, rotational torque will be imposed. The direction of rotational torque on portions of vessel mooring line 206 entering and leaving sheave 217 are indicated by curved arrow lines 225 and 226. As can be seen, the components of rotational torque shown by arrows 225 and 226 are in opposite directions such that no net rotational torque is imposed upon block 213.

Vessel mooring line 206 may also be a chain. In the event that chain is used as vessel mooring line 206, sheave 217 in FIG. 3 will preferably be a "wildcat" sheave equipped with pockets 224 in outer periphery 219. Pockets 224 are adapted to receive individual links of chain for relieving bending stresses as the chain passes around sheave 217. Blocks and sheaves which may be used as block 213 and sheave 217, both with and without pockets, are conventional, and their specific design does not form part of the improvements of the present invention.

In FIG. 2, swivel 207 connects block tail chain 214 to mooring line 215. Swivels are commonly used in mooring lines to relieve rotational torque from tensioned wire lines, and to allow positioning of equipment, such as block 213 and anchor 209, in a proper attitude for deployment. Swivel 207 may be positioned as shown in FIG. 2, or may be positioned to directly connect block 213 and block tail chain 214. Additional swivels may be employed as desired in the mooring tackle, such as at the connection of mooring line 215 and anchor chain 208 or at the connection of anchor chain 208 with anchor 209, for relieving rotational torque and for positioning equipment. Swivels are commonly used in mooring lines, and their further description is not required for an understanding of the improvements of the present invention.

In FIG. 2, mooring line 215 may be wire line, chain, or a combination of wire lines and chains, and is designed to withstand the full mooring tension required to maintain vessel 200 moored on station within the allowed degree of excursion from the center of its station during weather and sea conditions expected. The lower end of mooring line 215 is releasably attached to anchor chain 208 by means of a swivel, (not shown), or other connection means commonly used in mooring lines. Anchor chain 208 is attached to anchor 209, (or anchor piling 210), by a swivel or other connecting means, for transmitting mooring tension from mooring line 215 to anchor 209, (or anchor piling 210). Commonly, anchor chain 208 is larger and heavier than other lines in the mooring tackle for providing additional weight which tends to maintain a portion of anchor line 208 on the sea bed 212. By this means, mooring line tension is transmitted to anchor 209, (or anchor piling 210), by anchor line 208 at an angle approaching horizontal, thereby increasing the holding power of anchor 209, (or anchor piling 210). In some instances anchor 209 and anchor piling 210 may be designed to withstand larger vertical forces and maintain their holding power. When such "high uplift" anchoring means are used, additional weight on anchor chain 208 may not be required.

In operation, anchor 209 and anchor chain 208 are connected to mooring line 215 and deployed at a selected location on the sea bed 211. Alternatively, mooring line 215 is attached to anchor chain 208 and preset anchor piling 210. Then, vessel mooring line 206 is let out sufficiently to place block 213 and block tail chain 214 at a desired initial distance from vessel 200, and block tail chain 214 is attached to mooring line 215. These operations may be performed either from vessel 200, or with the assistance of an attendant vessel. After this initial deployment, vessel mooring line 206 is pulled by winch 204 to ensure that anchor 209 is properly set in sea bed 211, to impose the desired mooring tension on mooring line 215, and to place chain block 213 at its final position. Usefully, anchor 209 is set in sea bed 211 before mooring line 215 is attached to chain block tail chain 214 to minimize the subsequent take up of vessel mooring line 206 by winch 204 required to properly tension mooring line 215. The amount of elongation due to tensions applied to wire lines and chains used in mooring tackle are known. Therefore, the initial position of block 213, which will result in its desired final position after mooring tension is applied, may be readily calculated using methods well known in the art.

Preferably, block 213 has a final position at a water depth below the depth to which wave action reaches. Generally, wave action reaches a depth below the water surface 227 equivalent to the height of the waves. Consequently, block 213 is preferably positioned at a water depth greater than the height of the highest expected waves. Waves, especially storm waves, generate substantial forces, and block 213 has a relatively large surface area available for action by these forces. Therefore, positioning block 213 below the depth of wave action reduces stresses in block 213 and in the mooring tackle generally.

Preferably, the final lengths of the portions **206*b* and 206*c* of mooring line 206 will be sufficiently long to maintain block 213 at a desired water depth below expected wave action, and sufficiently short to maintain block 213 above sea bed 211 in the event vessel mooring line portions 206*b* and 206*c* would go completely slack such that block 213 would hang vertical down from first fairlead 205. The length of mooring line 215, for a selected mooring tension, can, in almost all cases, be selected to allow the preferred length for portions 206*b* and 206*c* of vessel mooring line 206 to be deployed. In instances where both criteria for the lengths of portions 206*b* and 206*c* of vessel mooring line 206 cannot be met, it is preferable that block 213 be maintained at a depth greater than the depth of expected wave action. In this case, reliance will be placed upon winch 204 to take up slack which may occur in vessel mooring line 206**.

The advantage of the improvement of the present invention arises from the mechanical advantage provided by vessel mooring line 206 running through block 213. For a single sheave 217 in block 213, the mechanical advantage is theoretically 2. In practical application, considering the angles at which vessel mooring line 206 enters and leaves sheave 217 and friction within the system, actual mechanical advantage will be in the range of about 1.75 to 2. This mechanical advantage provided by use of block 213 allows use of less powerful pulling equipment, such as winch 204, and smaller vessel mooring lines 206 than would otherwise be required with conventional mooring systems. For example, to provide a maximum tension of 500,000 pounds on mooring line 215, use of the improvement of the present invention allows use of pulling equipment, (winch 204), with only about 286,000 pounds pulling power. Likewise, for a mooring line 215 having a break strength of 1,000,000 pounds, (to provide a safety factor for the 500,000 pound tension), a vessel mooring line 206 having a break strength of only 572,00 pounds is required. As has been discussed above, a particular advantage of the improvement of the present invention is that mooring strength of existing mooring systems may be increased up to about 1.75–2 times without replacement of on board mooring equipment. Addition of block 213, use of stronger tackle from block 213 to anchor 209, and use of a larger anchor 209 is substantially less expensive than replacing the entire mooring system. Savings are, of course multiplied by the number of mooring systems on vessel 200.

Mechanical advantage can be increased even more by using more than one sheave in block 213, along with the necessary additional sheaves and fairleads on vessel 200. This arrangement requires two additional portions of vessel mooring line 206 for running between vessel 200 and block 213 for each additional sheave. Depending upon the lateral space available, a practical limit will be reached when the various portions of vessel mooring line begin to interfere with each other, or when deployment of the system becomes unwieldy.

A preferred embodyment of the improvements of the present invention is described in this specification. Other embodiments, variations and modifications which are within the spirit and scope of the present invention will occur to those skilled in the art, which embodiments, variations and modifications are intended to be included within the present invention, and no limitations to the present invention are intended except limitations contained in the appended claims..

We claim:

1. In a mooring system for mooring a vessel, having a hull with a waterline, in a body of water, having a water surface and a bottom at a depth beneath the water surface, in a mooring area subject to waves which generate a wave action which extends below the water surface, said mooring system comprising: a vessel mooring line having a free end; pulling equipment located on-board the vessel and attached to the vessel mooring line, for extending, retracting and tensioning the vessel mooring line; mooring tackle having a first end and a second end; and anchor means for anchoring the vessel to the bottom connected to the second end of the mooring tackle, the improvement which comprises:

a) a first fairlead attached to the vessel near the waterline for receiving the vessel mooring line first end from the pulling equipment and freely passing the vessel mooring line outward from the vessel;

b). a block, located a distance away from the vessel hull, comprising block fairlead means for receiving and freely passing the vessel mooring line free end from the first fair lead, and further comprising block connecting means for connecting the block to the first end of the mooring tackle; and c). attachment means connected to the vessel for attaching the vessel mooring line free end received from the block fairlead to the vessel;

wherein, with the vessel moored, the vessel mooring line and the mooring tackle define a catenary from the first fair lead to the anchor means.

2. The improvement of claim 1, wherein the attachment means is a releasable attachment means spaced laterally along the vessel away from the first fairlead in an accessible location.

3. The improvement of claim 1, including:

the anchor means comprising an anchor chain having an end connected to the mooring tackle; and the vessel mooring line and the mooring tackle defining a catenary from the first fair lead to the anchor chain having a curve sufficient to maintain the block at a water depth below the depth to which wave action may be expected to extend in the mooring area.

4. The improvement of claim 3, including, the mooring tackle including swivel means for relieving twisting torque on the block.

5. The improvement of claim 4, including, the vessel mooring line comprising a chain composed of links, the block fairlead comprising a sheave having pockets on its periphery for receiving links of the vessel mooring line chain, and the first fairlead comprising a sheave having pockets on its periphery for receiving links of the vessel mooring line chain.

6. The improvement of claim 5, including a block tail line comprising a chain having a first end connected to the block connecting means and a second end connected to the first end of the mooring tackle.

7. The improvement of claim 4 wherein the vessel is a semi submersible vessel having as a hull at least one column connecting a vessel deck with a vessel pontoon, and wherein the first fairlead and attachment means are attached, in laterally spaced relation, to the column near the water line.

8. In a mooring system for mooring a vessel, having a hull with a waterline, in a body of water having a water surface and a bottom at a depth beneath the water surface, in a mooring area subject to waves which generate a wave action which extends below the water surface, said mooring system comprising: a vessel mooring line having a free end; pulling equipment located on-board the vessel and attached to the vessel mooring line, for extending, retracting and tensioning the vessel mooring line; mooring tackle having a first end and a second end; and anchor means for anchoring the vessel to the bottom connected to the second end of the mooring tackle, the improvement which comprises:

a). a first fair lead attached to the vessel near the waterline;

b). a block, located a distance away from the vessel, and comprising block fairlead means for receiving and freely passing the vessel mooring line free end extended from the pulling equipment, and further comprising block connecting means for connecting the block to the first end of the mooring tackle;

c). a second fairlead attached to the vessel near the waterline at a position laterally spaced from the first fairlead, for receiving and freely passing the vessel mooring line from the block fair lead; and d). releasable attachment means connected to the vessel in an accessible location for releasably attaching the vessel mooring line free end to the vessel; wherein, with the vessel moored, the mooring line and the mooring tackle from the first fair lead to the anchor means define a catenary.

9. The improvement of claim 8, including:

the anchor means including an anchor chain having an end connected to the mooring tackle; and the vessel mooring line and the mooring tackle from the first fair lead to the anchor chain defining a catenary having a curve sufficient to maintain the block at a water depth below the depth to which wave action may be expected to extend in the mooring area.

10. The improvement of claim 9, including, the mooring tackle including swivel means for relieving twisting torque imposed on the block.

11. The improvement of claim 9, including:

the vessel mooring line comprising a chain composed of links;

the block fairlead comprising a sheave having pockets on its periphery for receiving links of the vessel mooring line chain;

the first fairlead comprising a sheave having pockets on its periphery for receiving links of the vessel mooring line chain.

12. The improvement of claim 11, including, a block tail line having a first end connected to the block connecting means and a second end connected to the first end of the mooring tackle.

13. The improvement of claim 9 wherein the vessel is a semi submersible vessel having as a hull at least one column connecting a vessel deck with a vessel pontoon, and wherein the first fairlead and second fairlead are attached, in laterally spaced relation, to the column near the water line.

* * * * *